United States Patent [19]

Boisvert

[11] 4,131,138

[45] Dec. 26, 1978

[54] HAND WEAVING LOOM

[76] Inventor: Guy Boisvert, 975 Belleville Ave., St. Vincent de Paul, Canada

[21] Appl. No.: 847,514

[22] Filed: Nov. 1, 1977

[30] Foreign Application Priority Data

Nov. 3, 1976 [GB] United Kingdom ..... 45697/76

[51] Int. Cl.[2] ..... D03D 29/00

[52] U.S. Cl. ..... 139/29; 28/152; 139/34

[58] Field of Search ..... 66/1, 1 A, 3, 4, 5; 28/151, 152, 140, 141, 142, 143, 144, 145–149; 139/29, 34

[56] References Cited

U.S. PATENT DOCUMENTS

| | | | |
|---|---|---|---|
| 709,535 | 9/1902 | Comstock | 139/34 |
| 2,273,446 | 2/1942 | Meyer | 28/152 |
| 2,382,048 | 8/1945 | Fox et al. | 139/34 |
| 2,457,064 | 12/1948 | Parsi | 66/4 |
| 2,582,008 | 1/1952 | Clack | 139/29 X |
| 2,634,532 | 4/1953 | Englert | 28/149 |
| 3,971,109 | 7/1976 | Garza | 28/151 |

FOREIGN PATENT DOCUMENTS

| | | | |
|---|---|---|---|
| 632003 | 12/1961 | Canada | 28/149 |

*Primary Examiner*—Ronald Feldbaum

[57] ABSTRACT

Hand weaving looms of simple and inexpensive construction adapted to produce a wide variety of woven products and which are simple to use, even by children. These hand weaving looms comprise a base including a central post, a work platen at the top of the post, pins projecting upward from the work platen, laterally spaced apart along the edge of the latter, and having each a head adapted to hold a warp yarn, a warp yarn holder including a plurality of yarn holding pegs, rods suspending said warp yarn holder from said work platen, and releasable connections collapsably connecting said work platen and warp yarn holder to said post and to said rods. In one embodiment, the work platen and the warp yarn holder are circular while in another embodiment, the same are rectilinear.

11 Claims, 12 Drawing Figures

HAND WEAVING LOOM

This invention relates to hand weaving looms.

So far, there have been proposed hand looms wherein frames carry warp yarns around which the weft yarns are passed in various patterns. Such looms are found relatively bulky and requiring a fair amount of skill to be properly operated; as a result, there have been proposed frame-type weaving looms in replacement of such hand looms. The hand weaving looms proposed so far include pins or needles used to effectively replace, in whole or in part, the warp yarns. Such hand weaving looms are disclosed in U.S. Pat. No. 2,457,064 and in Canadian Patent No. 1,003,305. The hand weaving looms of these patents are not conventionally using warp yarns, and are not readily collapsible.

It is a general object of the present invention to provide a hand weaving loom adapted to avoid the above-mentioned disadvantages.

It is a general object of the present invention to provide a weaving loom which is adapted to be simple to use by children as by adults.

it is an object of the present invention to provide a hand weaving loom which is easily portable and collapsible for removal of transportation and space problems and for popular use thereof.

It is another object of the present invention to provide a weaving loom which can easily and economically be manufactured by unskilled persons and with inexpensive materials, such as wood, plastic and light metals.

The above and other objects and advantages of the present invention will be better understood with reference to the following detailed description of preferred embodiments thereof, which are illustrated, by way of example, in the accompanying drawings, in which.

Figure 2:
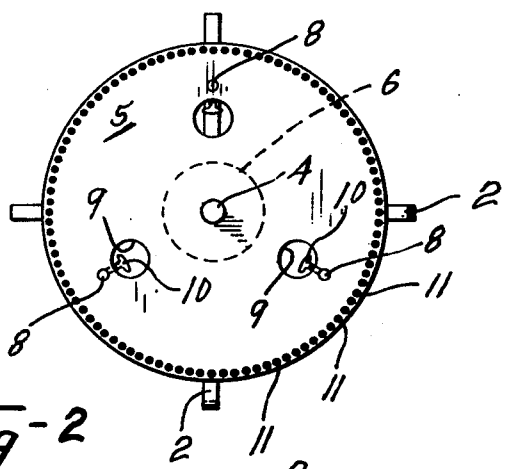
FIG. 2 is a top view of the circular hand weaving loom.
Figure 4:
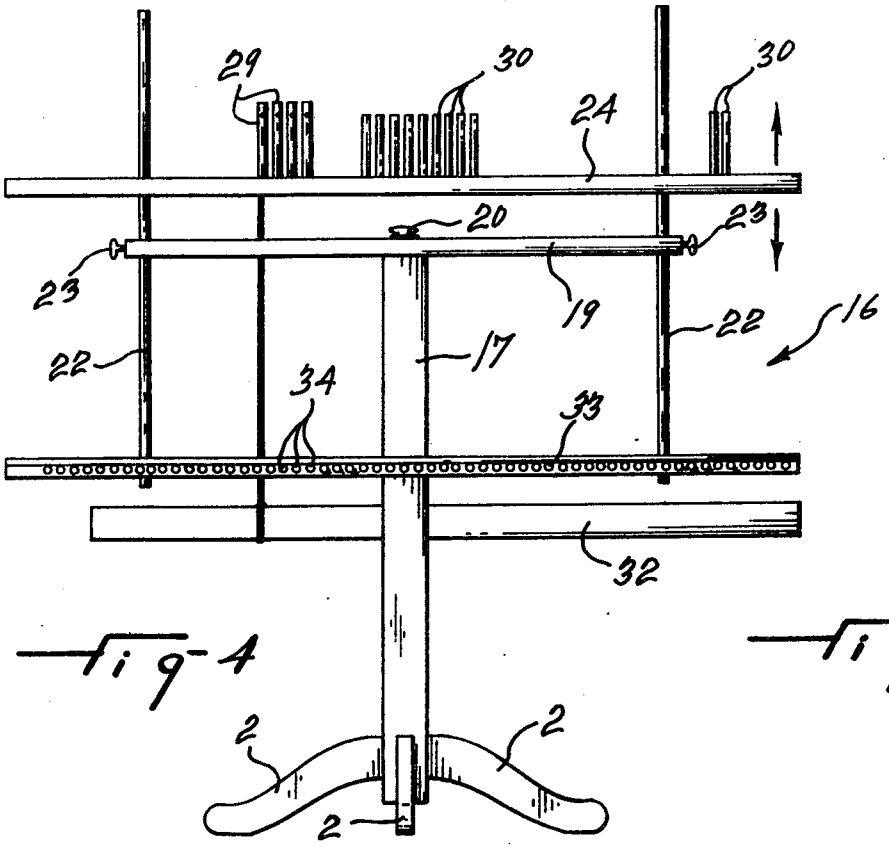
FIG. 4 is a front elevation of a rectilinear hand weaving loom according to the present invention.
Figure 6:
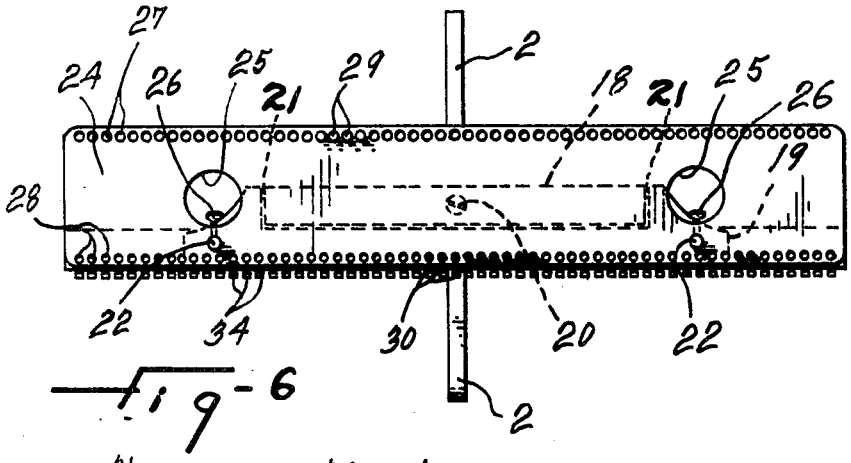
FIG. 6 is a top view of the rectilinear hand weaving loom.
Figure 8:
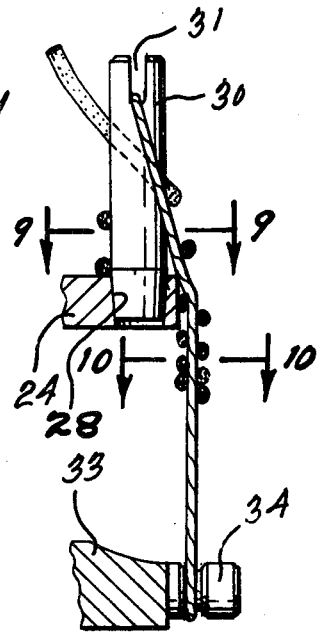
FIG. 8 is a side view as seen from the left in FIG. 7.
Figure 9:
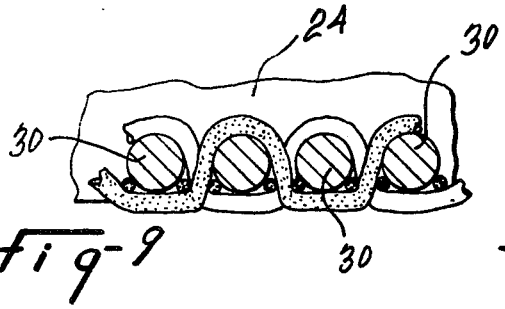
Figure 10:
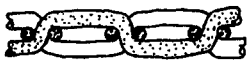
Figures 11, 12:
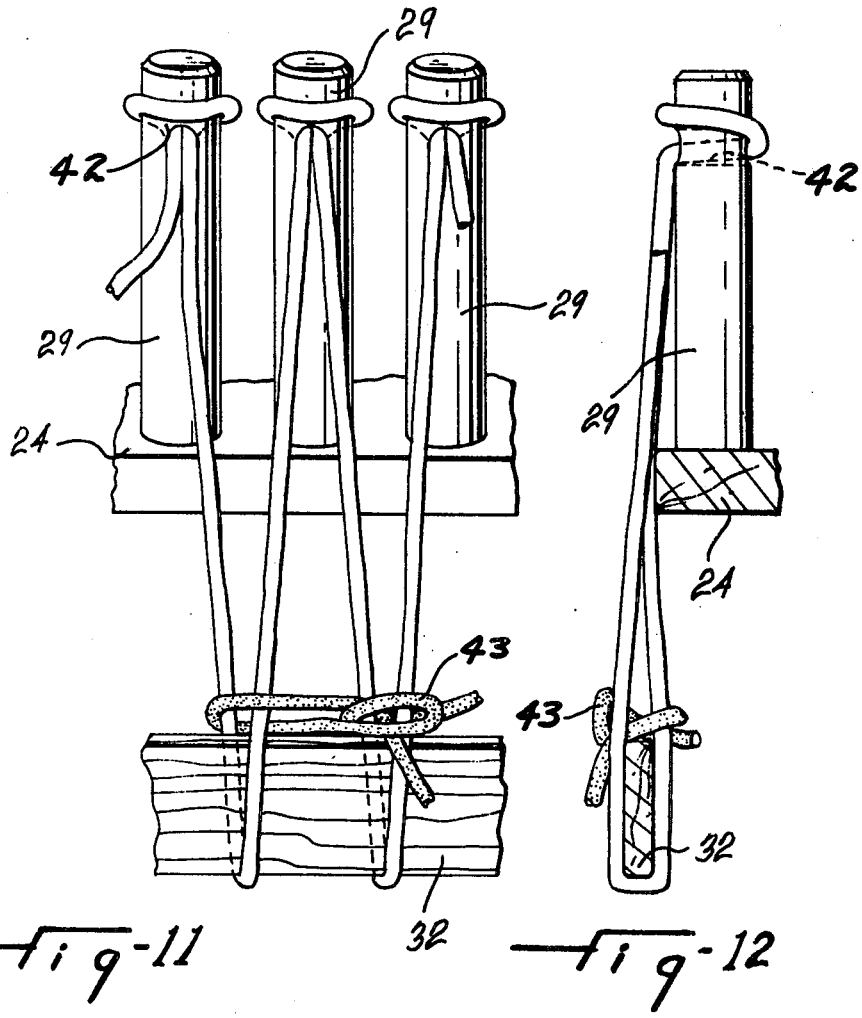

FIGS. 9 and 10 are cross-sectional views as seen along lines 9—9 and 10—10, respectively, in FIG. 8;

FIG. 11 is a perspective view of a portion of the rectilinear weaving loom as seen from behind in FIG. 4; and FIG. 2 is a side view as seen from the right in FIG. 11.

Figure 3:
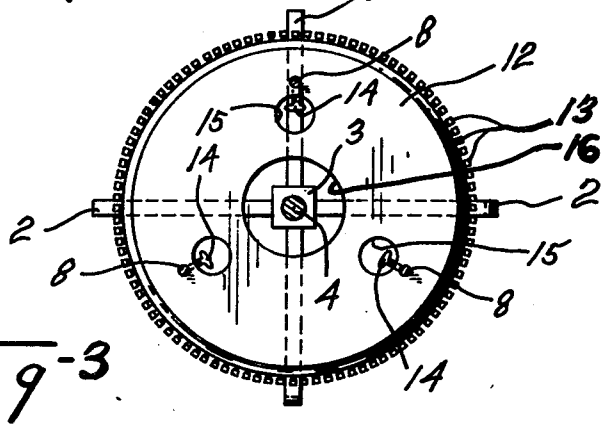
FIG. 3 is a cross-sectional view as seen along line 3—3 in FIG. 1.
Figure 1:
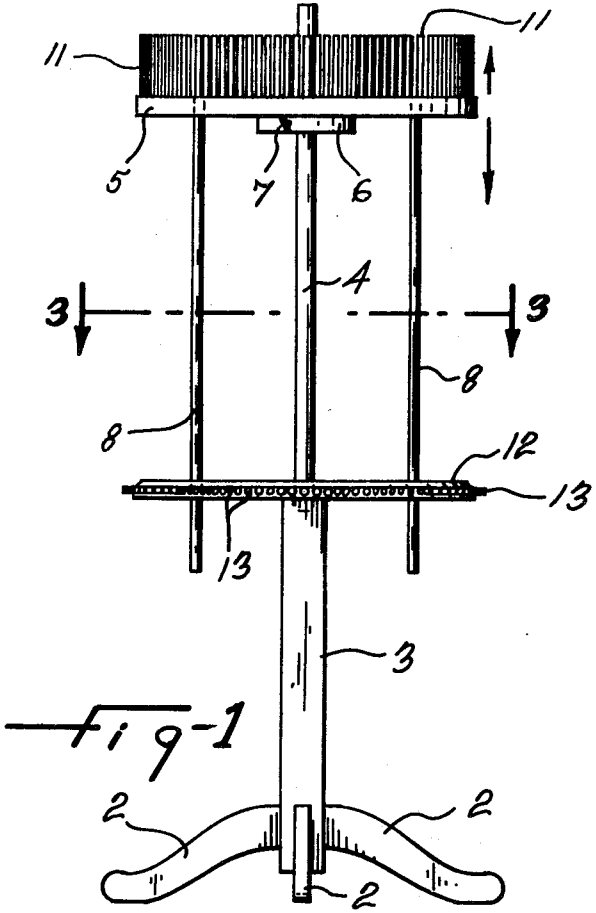
FIG. 1 is an elevation view of a circular hand weaving loom according to a preferred embodiment of the present invention.
Figure 5:
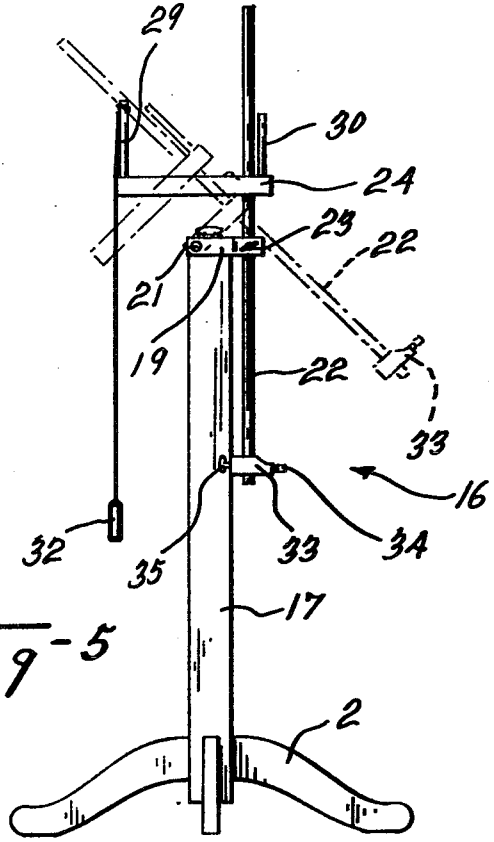
FIG. 5 is a side view of the rectilinear hand weaving loom.

The circular hand weaving loom illustrated in FIGS. 1—3 comprises a base, or stand, including legs 2 and a post which is fixedly secured to the legs. The post includes a lower portion 3, of square cross-section, and an upper portion 4, of circular cross-section.

A circular work platen 5 is carried by a hub portion 6 which is releasably and adjustably secured on the upper post portion 4 by a thumb screw 7. Thus, the work platen 5 may be adjusted in height along the upper post portion 4. Three rods 8 are engaged at the upper end in the work platen 5 and project endwise downwardly thereof. Adjacent each rod 8 therein is formed in the work platen 5 a hole 9, of sufficient size to screw a thumb screw 10, which serves to adjustably and releasably clamp the corresponding rod.

A plurality of pins, or needles 11, are removably secured in holes, not shown, provided in the top of the work platen. These holes are arranged such that the pins project upright from the work platen and are laterally spaced apart along the peripheral edge of the platen, as shown in FIGS. 1 and 2.

Below the work platen 5, there is provided a platen 12, of the same circular size as the platen 5. This platen 12 includes pegs 13 and cooperatively forms therewith a holder for the warp yarns. The warp yarn holder pegs 13 are radially engaged in the circular periphery of the warp yarns holder platen 12. The three rods 18 are slidably engaged in the corresponding holes of the lower platen 12. The latter is adjustably and releasably fixed to the rods 8 by thumb screws 14 engaged in corresponding holes 15 functionally corresponding to the holes 9 and thumb screws 10 for the upper platen 5. The platen 12 is provided with an enlarged central aperture 16 to provide clearance for the square post portion 3 and allow relative rotation with the latter.

Both platens 5 and 12 are bodily rotatable relative to the carrying post 3-4 or base 2-3-4.

Figure 7:
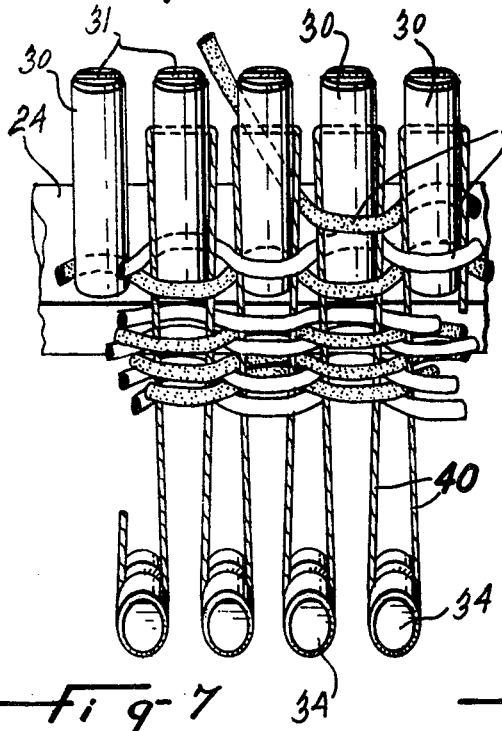
FIG. 7 is a perspective view of a portion of the rectilinear hand weaving loom showing the arrangement of the yarns for a weaving operation.

It will be readily understood that the lower platen 12 is adjustable up and down along the rods 8 to a selected distance from the upper platen. Continuous warp yarn can be hooked each in a slot or notch 31 (see FIG. 7) in the head of a pin 11 and looped around one peg 13. The weft yarns are thereafter woven around the pins 11 in any suitable and known manner to produce a desired tubular woven product.

It should also be understood that the rods 8 and thumb screw connections allow to not only adjust the above-mentioned distance but also to readily collapse the weaving loom.

The rectilinear hand weaving loom 16, illustrated in FIGS. 4 to 12 inclusive, also includes a base comprising legs 2 and a post 17, of square cross-section, fixedly secured to the corresponding legs. The base of this hand weaving loom also includes a pivotal connection comprising a first crossbar 18 pivotally carrying a second crossbar 19. The first crossbar 18 is pivotally and removaly secured on the head of the post 17 by a thumb screw 20 to allow rotation thereof about an upright axis. The second crossbar 19 is pivoted to the first crossbar 18 about a horizontal axis extending longitudinally of the first crossbar, as shown by pivot 21 in FIG. 5.

A pair of rods 22, similar to the rods 8, extend upright through the opposite ends respectively of the second crossbar 19 and are adjustably and releasably restrained against sliding each by a thumb screw 23 in the corresponding end of the second crossbar.

A work platen 24, in the form of a longitudinal board or shelf, is carried by the two rods 22, which upwardly extend therethrough. The work platen 24 is provided with a hole 25 therethrough adjacent each of the rods 22. A pair of thumb screws 26 adjustably and releasably secure the work platen 24 to the rods 22 by engagement through the holes 25 respectively. The work platen 24 includes a row of holes 27 and 28 along the rear and the front edges thereof respectively. Relatively big pins 29 are removably engageable in the holes 27 to stand upright in laterally spaced-apart relationship along the corresponding rear edge of the work platen 24. Similarly, smaller pins 30 are removably engageable in the holes 28 to stand upright in laterally spaced-apart relationship along the corresponding front edge of the work platen 24. The pins 29 are provided with a bore diametrically through the head thereof. The pins 30 are provided, like the pins 11, with a slot 31 in the head thereof.

A strip, or bar 32, is provided to cooperate with the bigger pins 29 and provide a warp yarn holder. At the front of the hand weaving loom, there is provided a warp yarn holder which includes a bar 33 and a plurality of pegs 34. The warp yarn holder bar 33 underlies the work platen 24 and is connected thereto by the rods 22. The latter are slidably engaged through the warp yarn holder bar 33 and are secured by thumb screws 35 which provide for removal or height adjustment of the latter.

When weaving is done, using the pins 30, the operation is the same as with the afore-described circular hand weaving loom. The height of the woven product may be selected by appropriate spacing of the holder bar 33 below the work platen 24. Referring to FIGs. 7 to 10, a warp yarn 40 is laid in zig zag continuous manner around a bottom peg 34, through the slot 31 of a pin 30, around the next peg 34 and so on. Pairs of warp yarn strands 40 thus extend close to and on each side of pins 30 and down to pegs 34 which maintain the warp shed taut over the edge of work platen 24. A weft yarn 41 is then woven by hand around pins 30 and pairs of warp yarn strands 40 with the successive courses inserted in alternate manner. When a sufficient number of weft courses have been woven on pins 30, the holder bar 33 is first released from rods 22 if the warp yarn is non-stretchable and pins 30 are successively pulled out of their holes 38 and the woven weft courses are pushed down to transfer the same along the pairs of warp yarn strands 40 below the work platen and down against pegs 34. The pins 30 are placed back in their holes 28 after each transfer. Once the transfer is completed, the procedure is repeated. the same procedure takes place for the embodiment of FIGS. 1 to 3 using pins 11 and pegs 13. In the latter case, the end product can be a woven tube. If a longer piece, or product, is desired, it is possible to thread a previously woven section with the loops of the warp yarn around the pegs 34 after a new warp yarn has been put in place. A weft yarn is then woven on this new warp yarn as previously described.

The bigger pins 29 at the rear of the hand weaving loom produce a coarser weaving of any length desired. The warp yarn holder bar 32 may be placed at any desired distance from the pins 29. The warp yarn in this case is connected in a continuous fashion through a hole 42 in the head of one pin, (see FIGS. 11 and 12) to the holder bar 32, through the next pin, to the holder par, and so on. A chain weaving 43 is thereafter made along the bar 32 to tightly secure the warp yarns against the bar and with substantially equal spacing along the same. Weaving is effected as described for FIGS. 7—10.

The pivoting between the crossbars 18 and 19 allows to tilt the working part of the hand weaving loom forward, such as to rest the warp yarn holder bar 33 on a user's lap while the same is comfortably sitting.

What I claim is:

1. A hand weaving loom comprising a base having a post, a work platen connected to the top of said post, pins removably secured to said work platen and upwardly projecting endwise therefrom in laterally spaced-apart relationship, said pins extending in a row along an edge of said work platen, each of said pins having a warp yarn holding means at the free end portion thereof remote from the work platen, rods downwardly projecting endwise from the work platen, and a warp yarn holder adjustably carried by said rods at a distance below said work platen.

2. a hand weaving loom as claimed in claim 1 wherein said warp yarn holder includes a second platen arranged substantially parallel to said work platen and having spaced pegs laterally projecting from an edge of said second platen, the spacing of the pegs being substantially equal to the spacing between said pins.

3. A hand weaving loom as claimed in claim 2, wherein said work platen and said second platen and said rods are releasably secured to one another and said work platen is releasably secured to said post, to allow dismantling of the loom to a collapsed condition.

4. A hand weaving loom as claimed in claim 1, wherein said work platen and warp yarn holder are bodily rotatable relative to the post.

5. A hand weaving loom as claimed in claim 2, wherein said work platen and said second platen constitute elongated members adjustably and removably secured to said rods and the latter extend through the opposite ends of said elongated members.

6. A hand weaving loom as claimed in claim 5, wherein said work platen includes a first bar removably fixed on the upper end of said post and a second bar pivoted to said first bar about an axis extending longitudinally thereof, and said rods extend through the opposite ends respectively of said second bar and are selectively adjustable and removable relative to the latter, said second bar carrying said pins.

7. A hand weaving loom as claimed in claim 6, wherein said second bar includes a row of apertures along each of the two opposite lateral edges thereof, said pins including a first set of pins engageable in one of said rows and a set of different pins engageable in the other of said rows.

8. A hand weaving loom as claimed in claim 2, wherein said work platen and said second platen are disk shape members of substantially equal diameter and coaxially arranged, and said pins and pegs are arranged in a circular row respectively.

9. A hand weaving loom as claimed in claim 1, wherein said pins have a slot at their top end, said slot constituting said warp yarn holding means.

10. A hand weaving loom as claimed in claim 1, wherein said pins have a transverse through bore near the top end thereof, said through bore constituting said warp yarn holding means.

11. A hand weaving loom comprising a base having a post, a work platen carried by the top of said post, said work platen having a series of holes made in the top surface thereof and disposed in a row adjacent an edge of said work platen, a series of pins each removably inserted in one of said holes and upstanding from said work platen, said pins having warp yarn holding means at the top thereof for holding a warp yarn, a bottom warp yarn holder located below said work platen and adjustable towards and away from said work platen, so arranged that a continuous length of warp yarn can be held in zig zag continuous manner alternately by the pins and by the warp yarn holder to form a warp shed with a pair of adjacent warp yarn strands running alongside each pin and below the same down to said bottom warp yarn holder so that weft yarn may be inserted between said needles and around the same and said pairs of yarn strands to weave several weft courses along said needles, and then said needles can be successively pulled out of their holes to transfer the weft courses downwardly along said pairs of warp yarn strands, around said edge and below said work platen towards said bottom warp yarn holder.

* * * * *